United States Patent [19]

Newland et al.

[11] Patent Number: 4,657,250

[45] Date of Patent: Apr. 14, 1987

[54] BASEBALL PITCHING PRACTICE APPARATUS

[76] Inventors: Paul H. Newland, Rte. 2, Box 2250A, Selah, Wash. 98942; Richard J. Briggs, 2205 S. 18th St., Space 47, Yakima, Wash. 98903

[21] Appl. No.: 715,249

[22] Filed: Mar. 25, 1985

[51] Int. Cl.[4] ..... A63B 71/02

[52] U.S. Cl. ..... 273/26 A

[58] Field of Search ..... 273/26 A, 26 R, 181 H, 273/201

[56] References Cited

U.S. PATENT DOCUMENTS

| | | | |
|---|---|---|---|
| 1,170,715 | 2/1916 | Westgate | 273/26 A |
| 2,943,141 | 6/1960 | Knight | 273/26 A |
| 3,194,556 | 7/1965 | Vinson | 273/26 A |
| 3,408,071 | 10/1968 | Lundy | 273/26 A |
| 3,814,438 | 6/1974 | Baron et al. | 273/181 H |
| 4,275,883 | 6/1981 | Grimaldi et al. | 273/26 A |
| 4,360,204 | 11/1982 | Karr | 273/201 |
| 4,437,672 | 3/1984 | Armantrout et al. | 273/181 H |
| 4,461,477 | 7/1984 | Stewart | 273/26 A |
| 4,489,941 | 12/1984 | Shieh | 273/26 A |
| 4,563,005 | 1/1986 | Hand et al. | 273/26 R |

*Primary Examiner*—Richard C. Pinkham
*Assistant Examiner*—T. Brown
*Attorney, Agent, or Firm*—B. P. Fishburne, Jr.

[57] ABSTRACT

A pitching practice apparatus includes a frontal mechanical strike zone target at which the pitcher aims the ball and which contains yielding elements enabling the ball to pass rearwardly through a photoelectric sensing plane having sensing beams on two orthogonal axes. Behind the photoelectric sensing arrangement which precisely locates the position of the ball in the strike zone horizontally and vertically is a spring-mounted ball return panel against which the pitched ball impinges and is returned to the pitcher by rebounding from the panel. A ball return trough forming the floor of the apparatus extends between the ball return panel and the frontal strike zone target.

5 Claims, 9 Drawing Figures

BASEBALL PITCHING PRACTICE APPARATUS

BACKGROUND OF THE INVENTION

Practice devices, both mechanical and electrical for baseball pitchers, are known in the prior art. Some such devices are primarily for amusement purposes while others seek to enhance the skill of the pitcher. No known prior art pitching practice apparatus is structured with the degree of sophistication and precision necessary to enable an experienced baseball pitcher, such as a professional, to improve his pitching skill by the use of the practice apparatus. Accordingly, it is the objective of the present invention to satisfy this need for a practice apparatus whose precision operation can and will significantly improve the pitching skill of the user of the apparatus, regardless of the skill level of the user, whether beginner, experienced amateur or professional.

In accomplishing the above objective, the apparatus in its essence provides a frontal mechanical target which precisely depicts the baseball strike zone in width and height. Behind this target is an electro-optical sensing means which senses the location of a pitched ball passing through it both horizontally and vertically with reference to the strike zone. Electrically coupled with the electro-optical sensing means, such as an orthogonal axis photoelectric system, is a visual display which depicts with precision the location and the path of movement of the pitched ball in the strike zone, with reference to home plate in both the horizontal and vertical planes. The display, which is appropriately embodied in a computer terminal, also provides a permanent visual record of each pitch with reference to the strike zone and home plate through a conventional computer terminal printer.

The apparatus also includes a conventional speed gun and speed display terminal by means of which the speed of each pitch is accurately monitored and visually displayed. Optionally, a closed circuit television system is included in the apparatus comprising a video camera aimed at the pitcher and an associated video recorder which can be electrically coupled to a computer display terminal. Through this means, a video record of the pitcher's throwing motion and technique on the pitching mound is produced and can be displayed, whereby the pitcher can discover his mistakes in form and delivery and seek to improve them.

The apparatus additionally includes a convenient foot-operated reset switch near the pitcher's mound for the purpose of returning the electronic components to a blank or cleared state after each pitch of the ball.

Other features and advantages of the invention will become apparent to those skilled in the art during the course of the following description.

DETAILED DESCRIPTION

Figure 1:
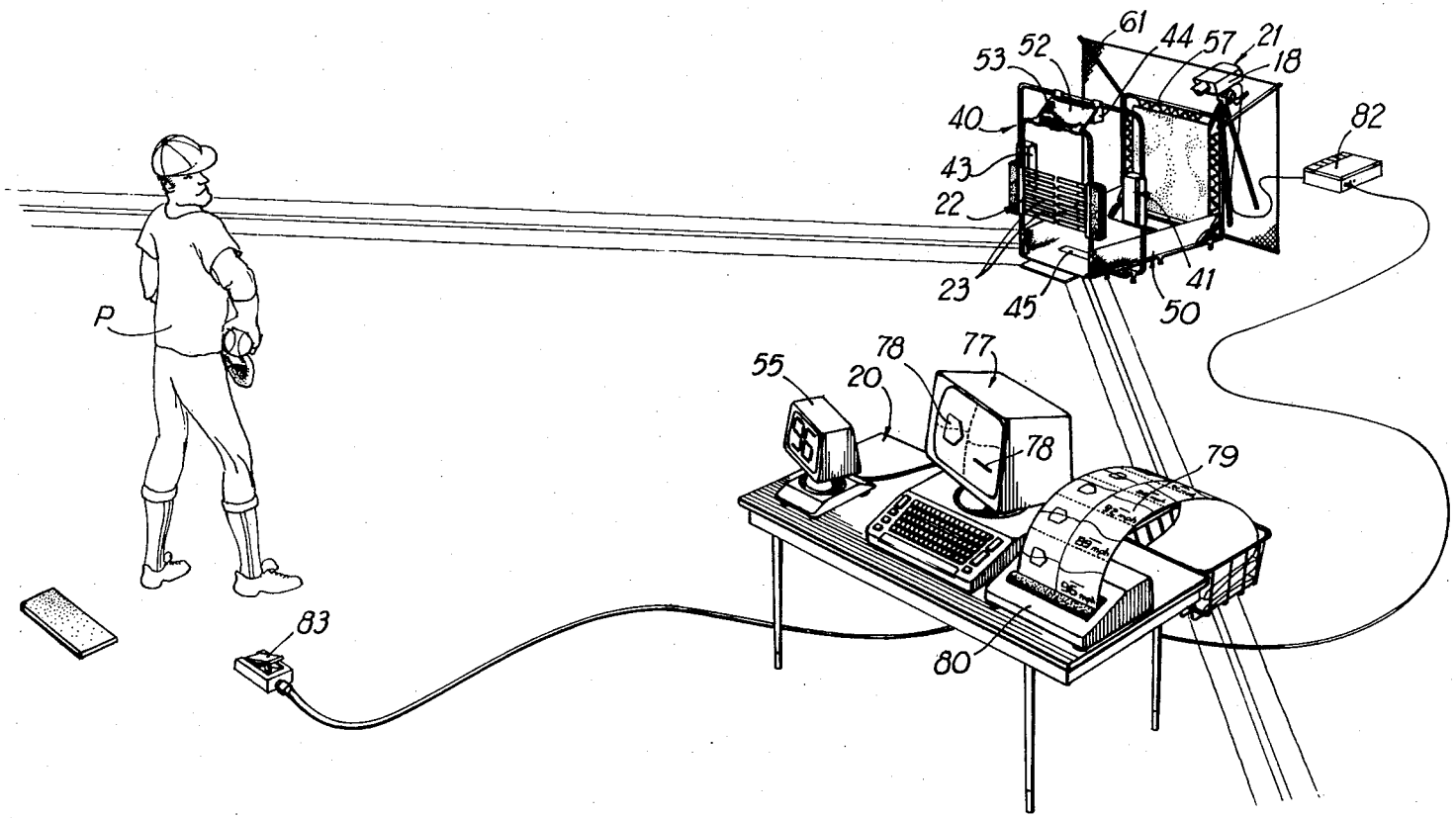
FIG. 1 is a perspective view of a baseball pitching practice apparatus according to the invention in its entirety.

Referring to the drawings in detail wherein like numerals designate like parts, FIG. 1 depicts a baseball pitching apparatus according to the invention in its entirety, and with its components assembled for use.

Figure 2:
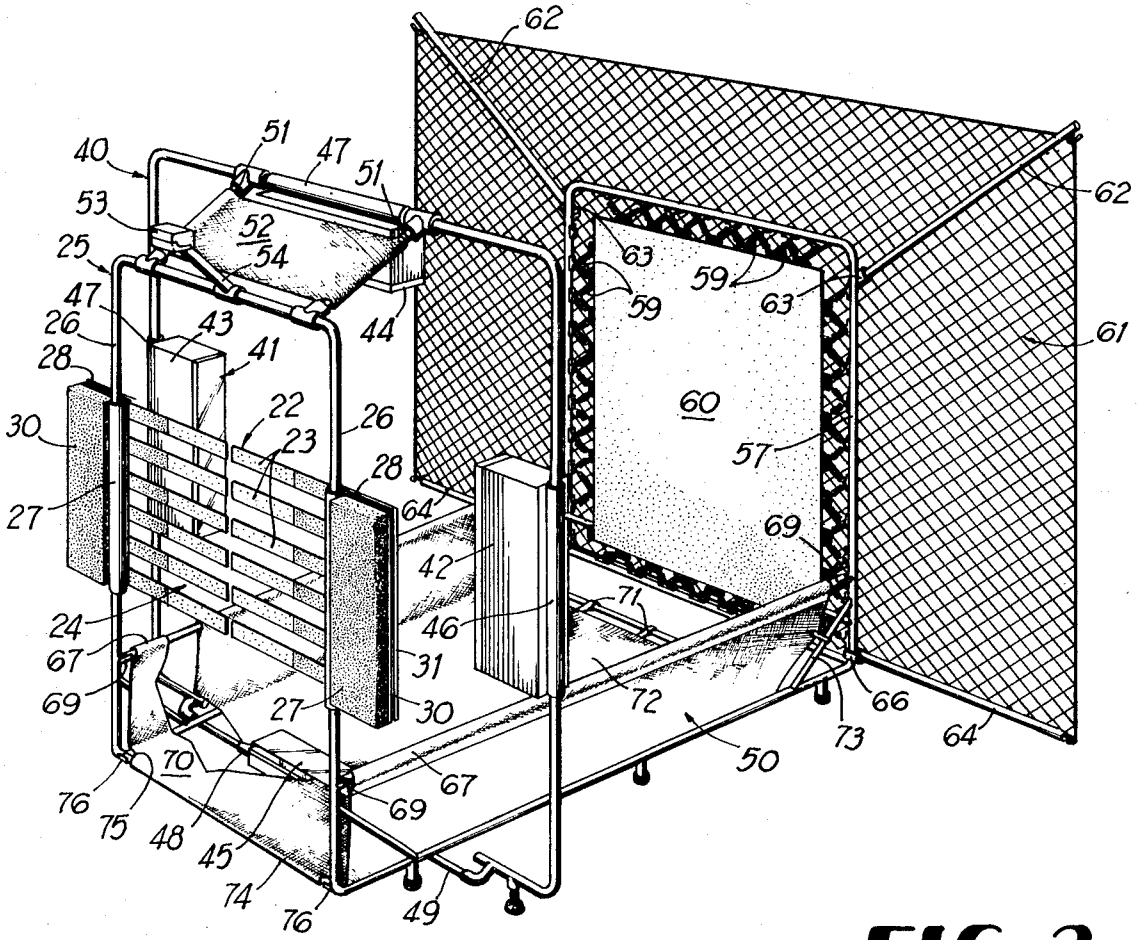
FIG. 2 is an enlarged perspective view of the apparatus minus the display and recording components.
Figure 3:
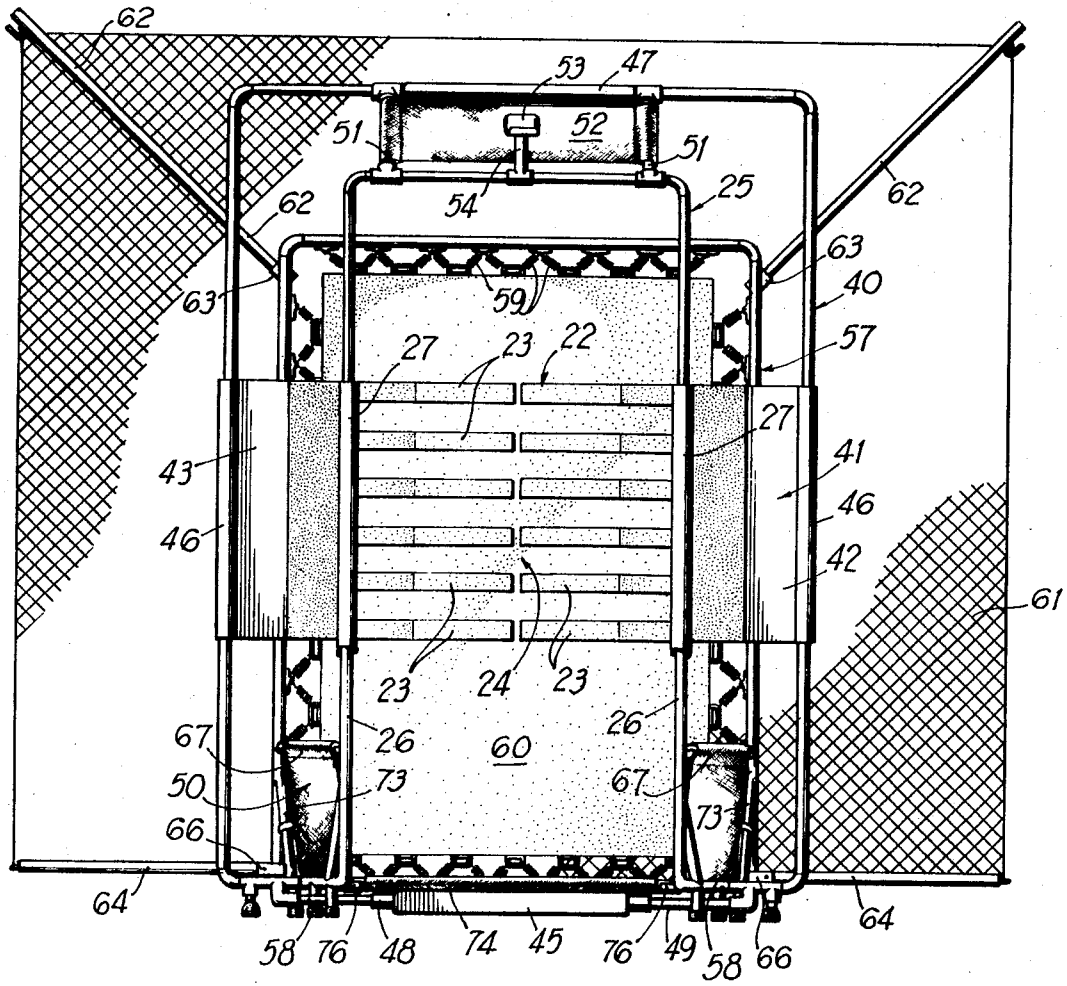
FIG. 3 is a front elevation of the apparatus as shown in FIG. 2.

FIG. 2 shows the apparatus without the visual display portion 20 in FIG. 1 and without an optional closed circuit television system 21 also present in FIG. 1. The components 20 and 21 will be further described.

The apparatus in FIGS. 2 through 9 comprises a frontal mechanical pitching target 22 consisting of two opposing groups of thin horizontal resilient equal length strips 23 lying in a common vertical plane and being spaced apart vertically equidistantly in each group, with their interior ends arranged in slightly spaced relationship at the transverse center of the apparatus. Preferably, the mechanical target strips 23 are formed of plastics material, such as polycarbonate or an equivalent material.

The interior end portions of the mechanical target strips 23 are colored white or blaze orange to delineate a rectangular target area 24 corresponding to the strike zone. The baseball strike zone, as is well known, measures 17-½ across home plate and is a variable dimension vertically corresponding to the distance between the arm pits and the tops of the knees of batters.

The pitching target 22 is supported at the front of the apparatus by an upright rectangular tubing frame 25 including spaced vertical frame bars 26. A target support tube 27 is adjustably mounted on each vertical bar 26 and has secured thereto and extending laterally outwardly therefrom a metal plate 28 having plural strips 29 of VELCRO or equivalent fastener means thereon. Immediately adjacent the forward sides of plates 28 are protective cushion pads 30 of foam rubber or the like secured to plywood backing plates 31 having VELCRO strips 32 on their rear faces to mate with the strips 29 for securing the pads 30 to the opposite sides of the mechanical target 22.

The outer end terminals 33 of target strips 23 lie rearwardly of the plates 28 and have apertures 34 formed therethrough to receive threaded studs 35 on the plates 28, projecting rearwardly thereof. Vertically extending polycarbonate strips 36 behind the end terminals 33 also have apertures 37 which register with the apertures 34 to receive the studs 35 therethrough. The elements 28, 33 and 36 are secured in assembled relationship by nuts 38 and washers 39 received by the studs 35.

Somewhat rearwardly of the mechanical target 22 is a second rectangular vertical tubing frame 40 of greater height and width than the frame 25. The second frame 40 serves to support an electro-optical sensing system 41, such as a vertical and horizontal axis photoelectric system to sense the exact location of the pitched baseball within the strike zone. The system 41 comprises a pair of opposite side invisible light projecting and receiving or sensing units 42 and 43 and a similar pair of top and bottom invisible light projecting and receiving or sensing units 44 and 45. The side and top and bottom electro-optical units are disposed and operate within a common vertical plane defined by the frame 40. It is completely immaterial as to which side of the frame 40 supports the projecting and sensing units, and it is similarly immaterial whether the projecting and sensing units of the system are on the top or bottom of the frame 40. In any case, invisible light beams are directed in a common plane, both horizontally and vertically, by the system 41 rearwardly of the mechanical target 22. Therefore, a baseball passing through the target 22 will interrupt a horizontal and a vertical beam or beams, which interruption establishes precisely the location of the baseball within the strike zone.

The vertical and horizontal electro-optical units of the system 41 are of the same height and width as the strike zone defined by the white or blaze orange mechanical target area. Therefore, a baseball within the strike zone area of the mechanical target 22 will penetrate the strike zone defined by the horizontal and vertical rays of the system 41. Pitched balls which miss the strike zone of target 22 will also miss the strike zone of electro-optical system 41 and will not be sensed by such system.

The side and top and bottom units of the electro-optical unit 41 are supported on the frame 40 by vertical and horizontal support sleeves 46 and 47 which receive the side vertical bars and horizontal top bar of the frame 40. The bottom horizontal unit 45 is similarly supported by a horizontal sleeve 48 which receives a somewhat depressed bottom horizontal bar 49 of the frame 40. Because of the depressed bar 49, the bottom unit 45 of the system 41 does not project above the floor of the apparatus defined by the bottom of a ball return trough 50, to be described.

The tops of frames 25 and 40 are interconnected by a pair of spaced inclined brace bars 51 having secured thereon a fabric guard panel 52 whose purpose is to protect the upper electro-optical unit 44 from being struck by baseballs. The cushion pads 30 are for the protection of the mounting structure shown in FIG. 6 for the mechanical target strips 23. The side units 42 and 43 are spaced apart sufficiently not to be in danger of being damaged by baseballs which are anywhere near the strike zone.

The apparatus further includes means to measure and indicate the speed of the pitched ball, comprising a conventional overhead speed gun 53 supported by an arm 54, attached to the top of frame 25 at its transverse center. A conventional ball speed display terminal 55 operatively connected with the speed gun 53 forms a part of the visual display system 20 previously noted in FIG. 1. The elements 53 and 55 are state-of-the-art equipment.

Figure 4:
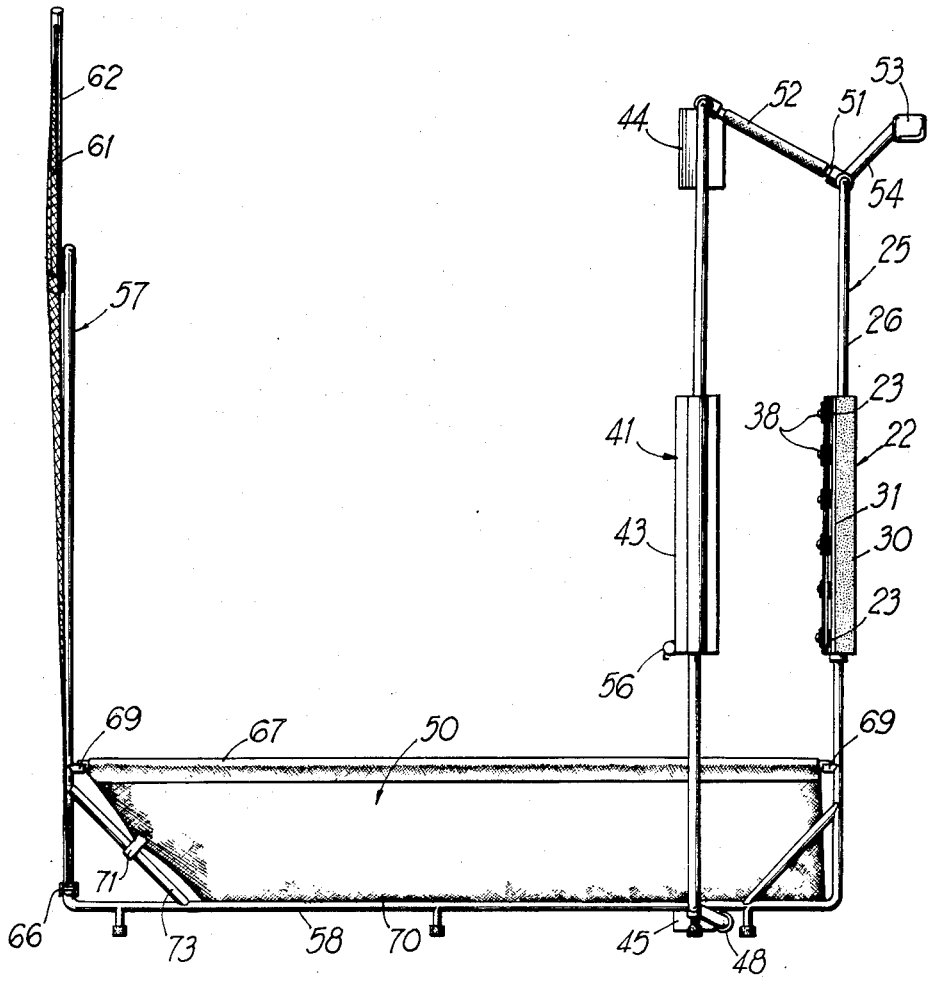
FIG. 4 is a side elevation of the apparatus.
Figure 5:
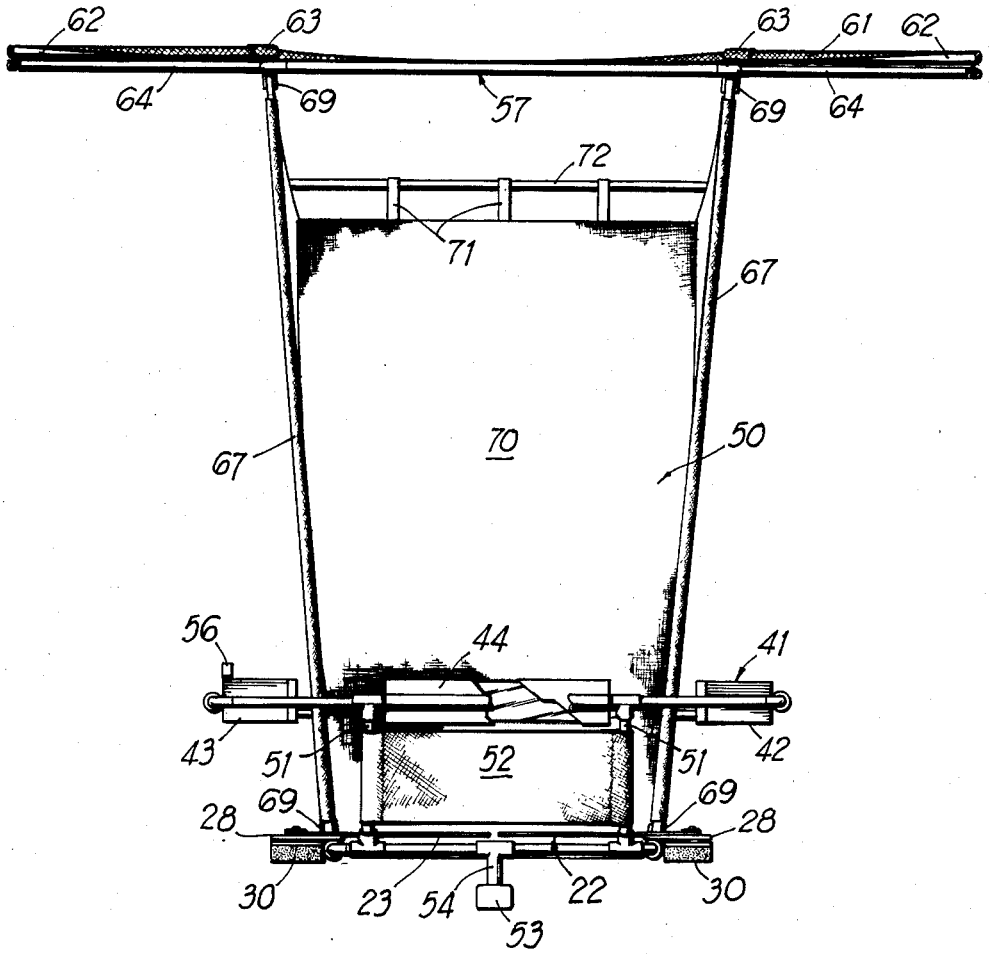
FIG. 5 is a plan view thereof.
Figure 6:
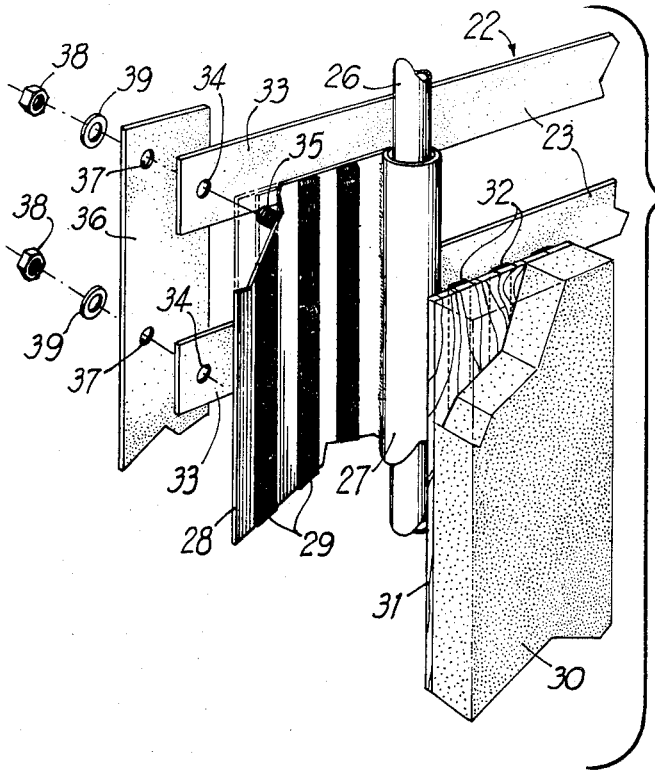
FIG. 6 is an exploded perspective view of mechanical target components.
Figure 7:
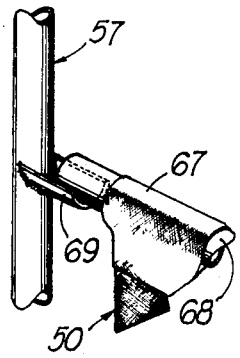
FIG. 7 is a perspective view of a ball return trough support detail.
Figure 8:
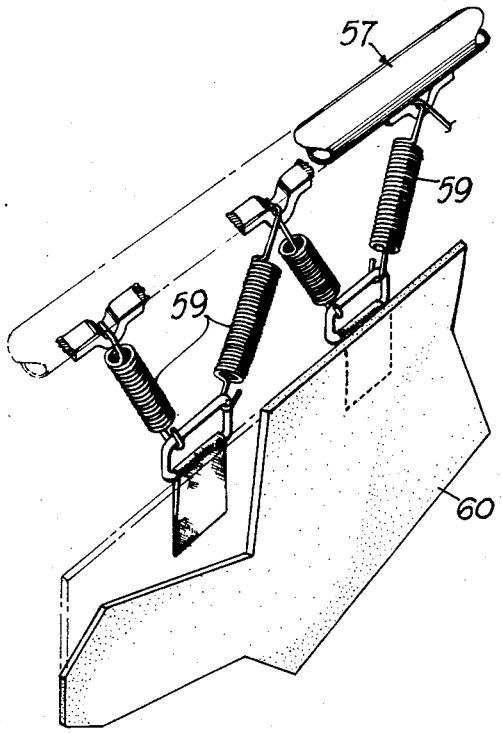
FIG. 8 is a fragmentary perspective view of a ball rebound panel and its support system.
Figure 9:
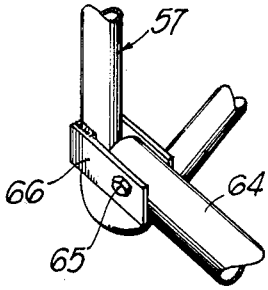
FIG. 9 is a fragmentary perspective view of a back stop support detail.

As a convenience feature for establishing the proper heights of the units 42 and 43 and the mechanical target 22 on the frames 40 and 25, a tape measure 56 is provided on the bottom of the unit 43, FIGS. 4 and 5.

Substantially rearwardly of the frame 40 is a third and smaller rectangular frame 57 which is vertical and parallel to the frames 25 and 40. The bottoms of the forward and rear frames 25 and 57 are rigidly interconnected by two horizontal bottom frame bars 58 which are somewhat forwardly convergent. The arrangement forms a sturdy integrated frame structure for the apparatus.

Held within the rear vertical frame 57 by a system of coil springs 59 is a taut rectangular rebound or ball return panel 60, preferably formed of polypropylene or the like. Surrounding the frame 57 and rebound panel 60 is an enlarged back stop 61 formed of suitable netting. This enlarged back stop spans the top and two sides of the frame 57. It is supported at its top by two diagonal arms 62 removably held in socket elements 63 on the frame 57. At its bottom, the netting back stop 61 is secured to a pair of folding horizontal arms 64, pivotally secured at 65, FIG. 9, to anchors 66, rigidly attached to the frame 57.

The ball return trough 50 formed of canvas or the like has opposite side tubular hems 67 which receive therethrough horizontal longitudinal forwardly convergent support bars 68, whose opposite end portions are supported by rests 69 on the frames 57 and 25 at an elevation above the bottom of the apparatus. The floor 70 of the ball return trough 50 is secured at its rear end by a series of VELCRO loops 71 to a crossbar 72 and is similarly secured to rear diagonal braces 73 of the framework, FIG. 4. The front of the trough 50, FIG. 3, has a tubular hem 74 which receives a support bar 75 held in rests 76 identical to the rests 69 in FIG. 7.

The mechanical construction of the apparatus shown in FIGS. 2 through 9 is quite simple and quite easy to erect and dismantle.

The display portion 20 of the apparatus, FIG. 1, further includes a state-of-the-art computer terminal 77 having a video display screen, on which is depicted the strike zone by a plan view of home plate 78 on one side of the display screen and a side elevation of the strike zone above an edge view of home plate 78 on the other side of the display screen. The computer terminal 77 is operatively coupled by state-of-the-art circuitry with the electro-optical sensing system 41, so that the exact location of each pitched ball within the strike zone, both horizontally and vertically, is depicted on the video screen. The flight path of the ball, whether straight or curved, is also depicted on the screen as shown in FIG. 1.

A permanent record of the location and flight path of each pitched ball is, or can be, made on a print-out sheet 79 of a conventional printer 80 operatively coupled to the computer terminal.

The closed circuit TV system 2l, preferably behind the netting back stop 61 includes a video camera 81 and an associated video recorder 82, both operatively connected with the computer terminal 77. The video system gives the apparatus an added dimension, in that the pitcher P can have his pitching motion monitored and recorded for observation at any desired time on the viewing screen of the computer terminal, as previously discussed. The video system could be omitted from the apparatus for the sake of economy in some cases, in which case the apparatus would still indicate the speed and location of each pitch and make a printed record thereof, as described.

Finally, the apparatus includes a foot-operated reset switch 83 on or near the pitching mound, whereby the pitcher can clear the electronic components of the apparatus after each pitch. All of the electronic components and their interconnecting circuitry are state-of-the-art and need not be further described to enable a full understanding of the invention.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. A baseball pitching practice apparatus comprising, a united framework including a bottom horizontal generally rectangular frame close to ground level, said frame having a forward end and a rearward end a forward vertical substantially rectangular frame attached to the forward end of the horizontal frame, an intermediate vertical substantially rectangular frame of greater width and greater height than the forward frame and spaced rearwardly thereof and also attached to said bottom horizontal frame, and a rear vertical substantially rectangular frame attached to the rear end of the bottom horizontal frame and being spaced rearwardly of said intermediate vertical frame by a distance substantially greater than the distance between the forward and intermediate vertical frames, a mechanical target mounted on the forward vertical frame including a pair of vertical tube members supported on opposite side members of the forward vertical frame, plural vertically spaced horizontal yielding target strips having corresponding ends secured to said tube members and extending from the tube members toward the transverse center of the apparatus and having other corresponding ends freely disposed in closely spaced relationship substantially at the transverse center of the forward vertical frame, and cushion pads held on said tube members and extending vertically along substantially the lengths of the tube members and the height of the mechanical target and being disposed immediately laterally outwardly of the side members of the forward vertical frame, electro-optical orthogonal axis pitched ball location sensing means on the top, bottom and opposite sides of said intermediate vertical frame and being operable in a vertical plane rearwardly of a vertical plane occupied by said yielding mechanical target strips, a vertical pitched ball rebound panel spring-suspended on the rear vertical frame, and a pitched ball return trough formed of flexible sheet material extending between the front and rear vertical frames and including a horizontal bottom wall attached to said bottom horizontal frame and a pair of upstanding side walls rising from the sides of the bottom horizontal frame and a pair of longitudinal support bars for said side walls connected between the forward and rear vertical frames of the united framework.

2. A baseball pitching practice apparatus as defined in claim 1, and a pair of bottom horizontal extension arms on the united framework at the juncture of the bottom horizontal frame and rear vertical frame and projecting laterally beyond opposite sides of the framework, a pair of upper diagonal extension arms secured to the rear vertical frame near the upper corners thereof and lying in a common vertical plane with said bottom horizontal extension arms, and a backstop netting connected with said bottom horizontal extension arms and said upper diagonal extension arms.

3. A baseball pitching practice apparatus as defined in claim 1, and an electronic pitched ball speed and location display means separate from and spaced from said united framework and being electrically coupled with the electro-optical pitched ball location sensing means and being located so as to be viewable by a user of the baseball pitching practice apparatus stationed substantially forwardly of the apparatus, said display means including a speed gun attached to the forward vertical frame of the united framework.

4. A baseball pitching practice apparatus as defined in claim 1, and an inclined overhead guard panel connected between the tops of the forward and intermediate vertical frames.

5. A baseball pitching practice apparatus as defined in claim 1, and said electro-optical pitched ball location sensing means comprising separate sensing units on the top, bottom and opposite sides of the intermediate vertical frame, and mounting tube members on the sensing units receiving the top, bottom and opposite side members of the intermediate vertical frame and being supported thereon.

* * * * *